US012448090B2

(12) United States Patent
Handley

(10) Patent No.: US 12,448,090 B2
(45) Date of Patent: Oct. 21, 2025

(54) COMBINATION RECREATIONAL VEHICLE AND HOUSEBOAT

(71) Applicant: Ian Matthew Handley, Tarpon Springs, FL (US)

(72) Inventor: Ian Matthew Handley, Tarpon Springs, FL (US)

( * ) Notice: Subject to any disclaimer, the term of this patent is extended or adjusted under 35 U.S.C. 154(b) by 535 days.

(21) Appl. No.: 17/805,785

(22) Filed: Jun. 7, 2022

(65) Prior Publication Data

US 2022/0324542 A1 Oct. 13, 2022

Related U.S. Application Data

(60) Provisional application No. 63/200,985, filed on Apr. 7, 2021.

(51) Int. Cl.
*B63B 35/44* (2006.01)
*B63B 3/48* (2006.01)

(52) U.S. Cl.
CPC ..... *B63B 35/44* (2013.01); *B63B 3/48* (2013.01); *B63B 2003/485* (2013.01); *B63B 2035/4426* (2013.01)

(58) Field of Classification Search
CPC ..... B63B 35/44; B63B 3/48; B63B 2035/485
See application file for complete search history.

(56) References Cited

U.S. PATENT DOCUMENTS

| | | | | |
|---|---|---|---|---|
| 2,794,192 | A * | 6/1957 | Paris | B63B 1/121 114/61.24 |
| 3,285,259 | A * | 11/1966 | Hale | B63B 17/02 114/361 |
| 3,371,672 | A * | 3/1968 | Hale | B63B 17/02 135/132 |
| 3,800,726 | A * | 4/1974 | Murphy | B63B 29/025 114/343 |
| 5,044,298 | A * | 9/1991 | Pepper | B63B 17/02 114/361 |
| 6,209,477 | B1 * | 4/2001 | Biedenweg | B60J 7/1282 114/361 |
| 7,159,531 | B2 * | 1/2007 | Baylor | B63B 17/02 114/361 |
| 7,249,568 | B1 * | 7/2007 | Cultrara | B63B 73/72 114/361 |
| 9,302,740 | B2 * | 4/2016 | O'Neal | B63B 35/613 |
| 10,723,421 | B2 * | 7/2020 | Hamilton | G06Q 30/0643 |
| 11,807,341 | B2 * | 11/2023 | Ritchel | B63B 34/00 |
| 2009/0178604 | A1 * | 7/2009 | McKeand | B63B 15/00 114/343 |
| 2018/0099726 | A1 * | 4/2018 | Broadway | B63B 3/48 |
| 2024/0425142 | A1 * | 12/2024 | Broadway | B63B 35/34 |

* cited by examiner

*Primary Examiner* — S. Joseph Morano
*Assistant Examiner* — Jovon E Hayes
(74) *Attorney, Agent, or Firm* — Dunlap Bennett & Ludwig, PLLC

(57) ABSTRACT

A combination recreation vehicle and houseboat having an upper enclosure assembly and a lower floating chassis assembly with a floor system portion, wherein the upper and lower assemblies are movable between a retracted condition and an extended condition independently of each other.

3 Claims, 4 Drawing Sheets

COMBINATION RECREATIONAL VEHICLE AND HOUSEBOAT

CROSS-REFERENCE TO RELATED APPLICATION

This application claims the benefit of priority of U.S. provisional application No. 63/200,985 filed 7 Apr. 2021, the contents of which are herein incorporated by reference.

BACKGROUND OF THE INVENTION

The present invention relates to recreation vehicles and watercraft and, more particularly, a combination recreation vehicle (RV) and houseboat having an upper enclosure portion and a lower floating chassis with a floor system portion, wherein the upper and lower portions are movable between a retracted condition and an extended condition independently of each other.

RVs do not typically float. Wide houseboats are typically too big to tow on roadways. Both are expensive. And both are typically purchased by the same demographic.

As can be seen, there is a need for a combination recreation vehicle (RV) and houseboat eliminating the need for having both an RV and a houseboat.

The present invention embodies a combination RV-houseboat having an upper enclosure portion and a lower floating chassis with a floor system portion, wherein the upper and lower portions are movable between a retracted condition and an extended condition independently of each other.

The combination embodied by the present invention can stay on the trailer as an RV or be dropped in the water as a houseboat. The present invention combines the RV and the houseboat into one system that can be used independently through providing an extendable chassis for a boat that opens independently of an extendable upper enclosed area. By being able to extend and retract independently of each other, the upper portion can be used in the extended condition as an RV yet in the retracted condition remain on a trailer securely in a street-legal manner; likewise, in the retracted condition the lower portion can be hauled on the trailer securely in a street-legal manner, yet the lower portion can be a very wide boat that opens fully in the water through the extended condition. The combination of the upper and lower portions creates a stable wide boat. Furthermore, when the bottom float system is in the extended condition and the upper is in the retracted condition the present invention provides for a walk around/center console style boat, that is excellent for fishing without physical restrictions.

In other words, the present invention provides a more versatile boat that can be used both in water and on land as a RV.

SUMMARY OF THE INVENTION

In one aspect of the present invention, a combination recreation vehicle and houseboat includes an upper enclosure assembly and a lower floating chassis assembly having a floor system portion, wherein the upper enclosure assembly is supported by the lower floating chassis assembly, and wherein said assemblies are movable between a retracted condition and an extended condition independently of each other.

In another aspect of the present invention, a combination extendable flotation system and upper deck system includes an extendable flotation system having a floor system portion, wherein the extendable flotation system is movable between a retracted condition and an extended condition; and an upper deck system supported on the floor system portion, wherein the upper deck system is an additional open deck elevated above the floor system.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a combination recreation vehicle and houseboat having an upper enclosure assembly and a lower floating chassis assembly with a floor system portion, wherein the upper and lower assemblies are movable between a retracted condition and an extended condition independently of each other.

Figure 1:
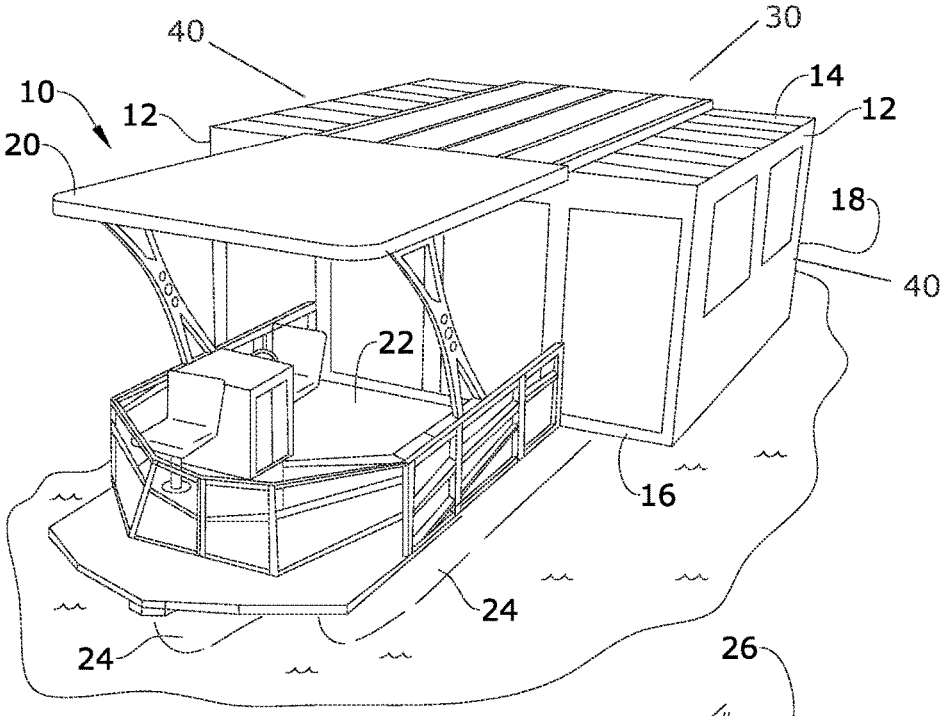
FIG. 1 is a front perspective view of an exemplary embodiment of the present invention, shown in use with the upper assembly 30 in an extended condition.
Figure 2:
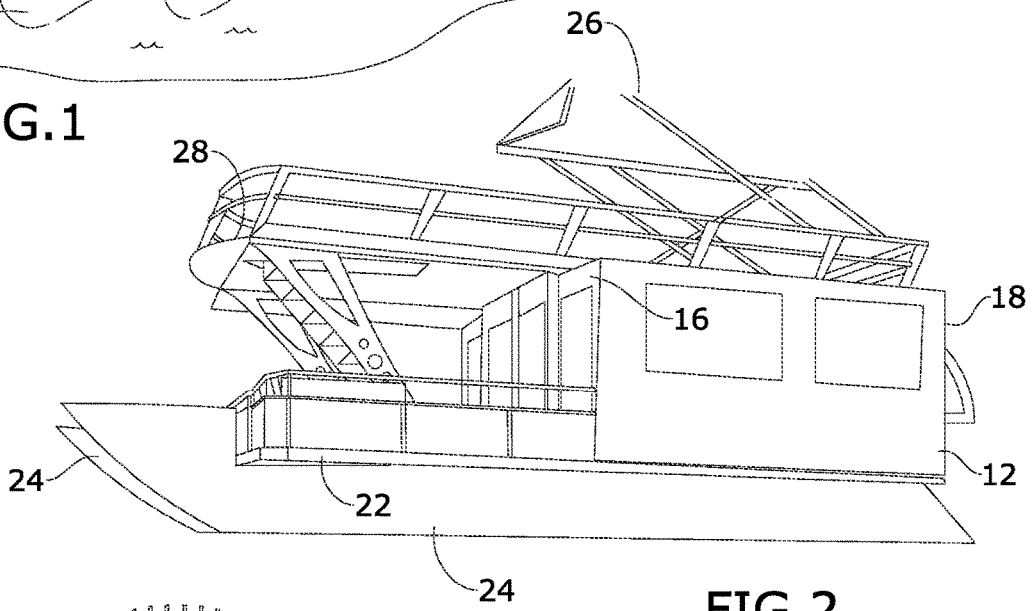
FIG. 2 is a side perspective view of an exemplary embodiment of the present invention, shown with the upper assembly 30 in an extended condition, and the floating chassis 24 in a retracted condition.
Figure 3:
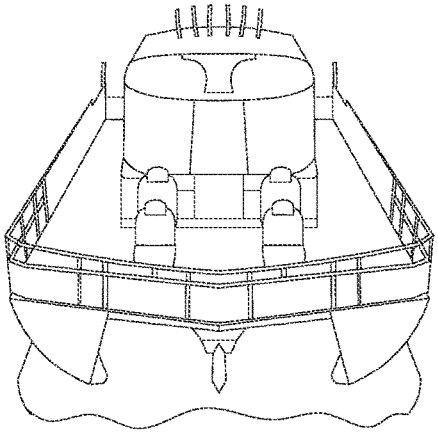
FIG. 3 is a front perspective view of an exemplary embodiment of the present invention, wherein the floating chassis 24 is shown in an extended condition and the upper assembly 30 in a retracted condition.
Figure 4:
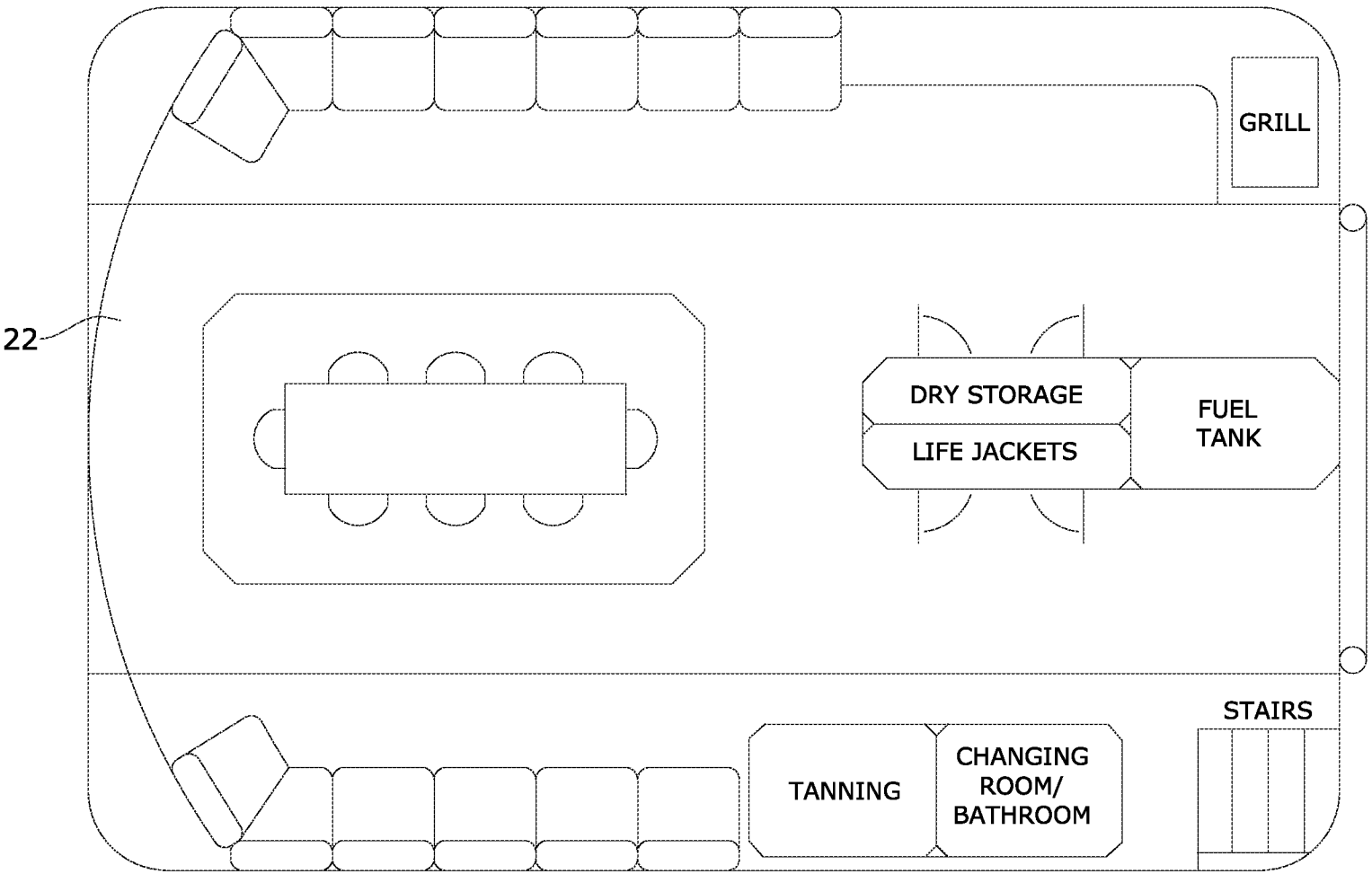
FIG. 4 is a top plan schematic view of an exemplary embodiment of the lower deck 22 of the present invention.
Figure 5:
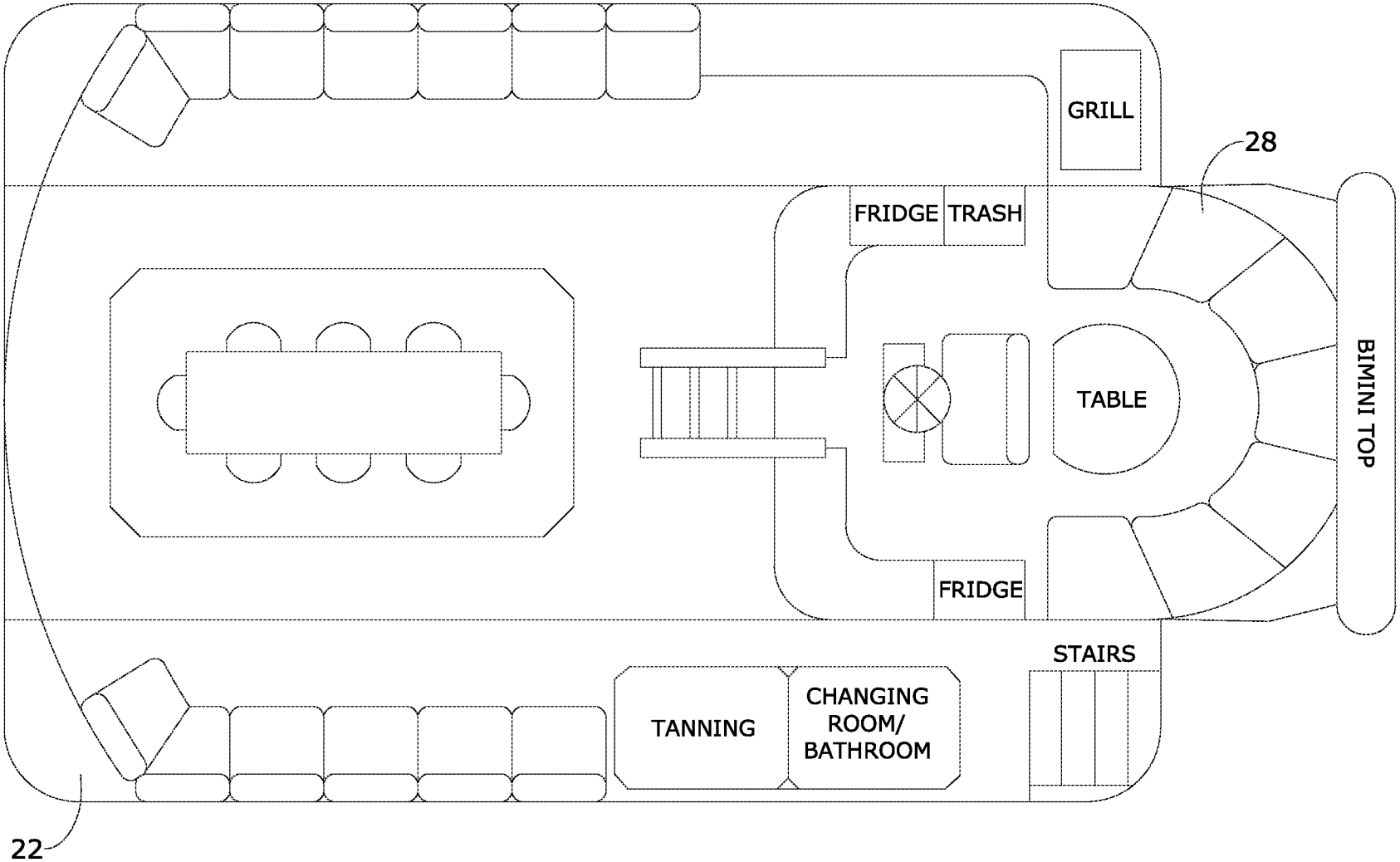
FIG. 5 is a top plan schematic view of an exemplary embodiment of the lower deck 22 and the upper deck 28 of the present invention, illustrating an elevated additional open deck.
Figure 6:
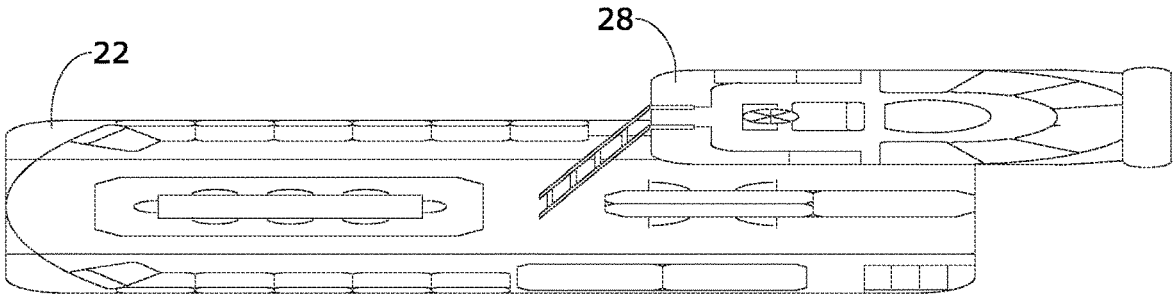
FIG. 6 is a side schematic view of an exemplary embodiment of the present invention shown with the upper and lower levels schematically split.
Figure 7:
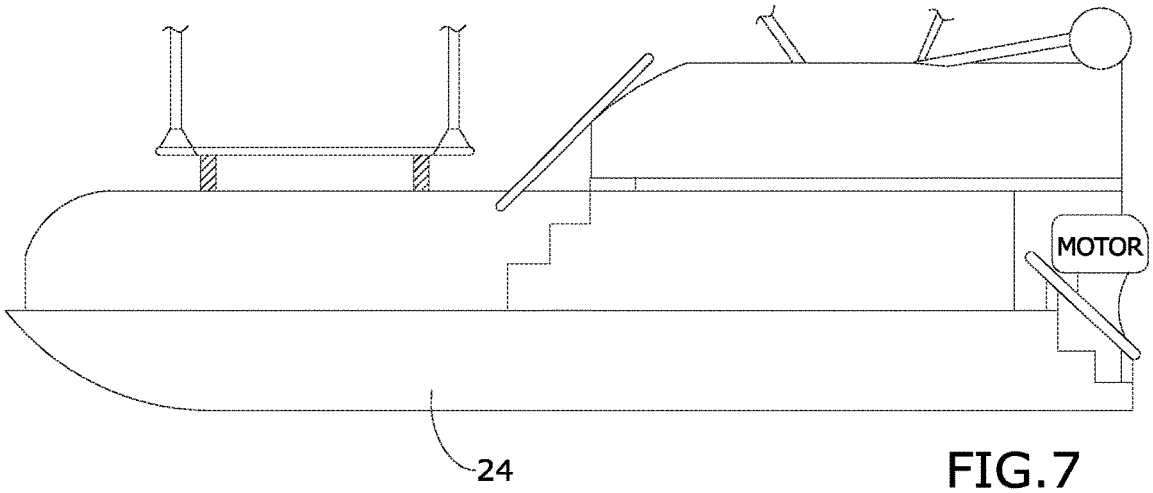
FIG. 7 is a side schematic view of an exemplary embodiment of the present invention.

Referring now to FIGS. 1 through 7, the present invention may include a combination RV-houseboat 10. The combination RV-houseboat 10 includes (i) a floating chassis assembly 24 with a floor system 22, or lower portion, that can extend and retract and (ii) an upper enclosure assembly 30, or upper portion, that is adapted to extend and retract independent of the floating chassis assembly 24. The upper and lower assemblies can independently extend and retract relative to each other. The upper assembly and the lower assembly are attached in such a way that they can still extend and retract independently. In other words, the present invention embodies two different systems joined together to create a new combination.

The upper assembly 30 may be shorter or longer than the lower float chassis assembly 24. The upper assembly 30 has two opposing, movable enclosures 40, each movable enclosure 40 having a side wall 12, a front wall 16, and a rear wall 18 and a roof system 14 mounted atop the side wall 12, the front wall 16, and the rear wall 18 so as to define an interior living space.

A deck roof 20 may be adjacent the roof system 14. The deck roof 20 may be supported by a floor system 22 of the floating chassis 24. In effect, the deck roof 20 and the floor system 22 define two opposing openings therebetween through which the two opposing, movable enclosures 40, respectively, may move between a retracted condition and an extended condition.

Each movable enclosures 40 may be mounted in said opening so as to be movable between a retracted position and an extended position. When in the retracted position, the movable enclosures 40 is retracted into the opening so as to be substantially positioned within a main housing and under the deck roof 20. When in the extended position, each movable enclosures 40 is extended outward from the opening so that a portion of the movable enclosures 40 is extended outward from the roof deck 20 opening or plane thereof.

Furthermore, the upper assembly 30 may include a securing system that engages with flooring system 22 of the floating chassis 24 and inhibits movement of the relevant movable enclosure 40 in the retracted position. Each movable enclosure 40 may be mounted in the opening defined by the deck roof 20.

Each movable enclosure 40 may move between its retracted position and its extended position in a known manner. In one embodiment, a motor (not shown) engages an actuator (not shown), such as a worm gear or screw drive, and the actuator moves each movable enclosure 40 between its extended and retracted position. In other embodiments, hydraulic components are used to move each movable enclosure 40 and in still other embodiments, each movable enclosure 40 is moved manually. It is understood that movement of each movable enclosure 40 could be achieved in numerous ways without departing from the spirit of the invention.

Each upper assembly 30 may have a floor positioned on the floor system 22 of the floating chassis 24.

In certain embodiments, the deck roof 20 may support a cover component 26. The deck roof 20 may support an upper deck 28.

The floating chassis 24 may include separable flotation devices that can open and close independently of the upper assembly 30 that also can move between extended and retract conditions independently. In certain embodiments, the floating chassis 24 may include an extendable flotation system having a center flotation device, two side flotation devices, an adjustable frame and a plurality of actuator arms. The adjustable frame may include a plurality of fixed frame elements and a plurality of slidable elements. The plurality of fixed frame elements may be supported in a traverse relationship to and along the length of the center flotation device. Each elongated slidable element may have a received end and an attached end. Each fixed frame element may be tubular having two opposing ends, wherein each opposing end may be adapted to slidably receive one received end. The plurality of hinged ends may be fixed to either one of the two side flotation devices. Each actuator arm has a fixed end and an extendable end, wherein the plurality of attached ends is connected to one fixed frame element, and wherein the plurality of extendable ends is connected to the two side flotation devices so that the two side flotation devices are extendable relative to the center flotation device by shifting the two side flotation devices between a contracted position to an expanded position.

In other embodiments, the extendable flotation system may move between its retracted position and its extended position in a known manner. In one embodiment, a motor (not shown) engages an actuator (not shown), such as a worm gear or screw drive, and the actuator moves the extendable flotation system between its extended and retracted position. In other embodiments, hydraulic components are used to move the extendable flotation system and in still other embodiments, the extendable flotation system is moved manually. It is understood that movement of the extendable flotation system could be achieved in numerous ways without departing from the spirit of the invention.

A method of making the present invention may include the following. A manufacture would join an existing extending float chassis to an existing upper enclosed assembly adapted to extend and retract independently of the float chassis. That may be shorter, equal, or longer than the lower float chassis. An independently extending upper system and an independently extending lower system are necessary. Different floats and floor configurations allow for different layouts. Also having the ability to have an upper/second level could prove to be beneficial The combination RV-houseboat 10 allows for a wider boat to be trailered and still be used as an RV when the user desires to use it on land, while still being street legal to tow down the roadway.

As used in this application, the term "about" or "approximately" refers to a range of values within plus or minus 10% of the specified number. And the term "substantially" refers to up to 90% or more of an entirety. Recitation of ranges of values herein are not intended to be limiting, referring instead individually to all values falling within the range, unless otherwise indicated, and each separate value within such a range is incorporated into the specification as if it were individually recited herein. The use of all examples, or exemplary language ("e.g.," "such as," or "the like") provided herein, is intended merely to better illuminate the embodiments and does not pose a limitation on the scope of the embodiments or the claims. No language in the specification should be construed as indicating any unclaimed element as essential to the practice of the disclosed embodiments. In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A combination recreation vehicle and houseboat, the combination comprising:

an upper enclosure assembly; and a lower floating chassis assembly having a floor system portion, wherein a maximum width of the floor system portion is defined by a starboard side and a port side, wherein the upper enclosure assembly is supported by the lower floating chassis assembly, and wherein said assemblies are movable between a retracted condition and an extended condition independently of each other, whereby, when both assemblies are in the extending condition, an extended width of the upper enclosure assembly projects beyond both the starboard side and the port side, while, when the upper enclosure assembly is in the retracted condition, a retracted width of the upper enclosure assembly is inward of both the starboard side and the port side so that the upper enclosure assembly defines a walkaround center console.

2. The combination of claim 1, comprising: an extendable flotation system having a floor system portion, wherein the extendable flotation system is movable between a retracted condition and an extended condition; and an upper deck system supported on the floor system portion.

3. The combination of claim 2, wherein the upper deck system is an additional open deck elevated above the floor system.

* * * * *